United States Patent [19]

Schmidt et al.

[11] Patent Number: 4,540,111

[45] Date of Patent: Sep. 10, 1985

[54] ARTICLE TRANSPORT APPARATUS

[76] Inventors: Volker Schmidt, 4638 Todds Rd., Lexington, Ky. 40509; Erich A. Schmidt, 2415 Liberty Rd., Lexington, Ky. 40505

[21] Appl. No.: 509,308

[22] Filed: Jun. 30, 1983

[51] Int. Cl.[3] ..... D05B 3/00; A41H 37/10

[52] U.S. Cl. ..... 227/8; 29/33 P; 198/345; 198/339.1; 198/468.2; 227/20; 227/24; 227/25; 227/119; 227/100; 112/65; 112/121.29; 112/121.11

[58] Field of Search ..... 29/33 SP; 198/345, 341, 198/486, 857; 222/1, 2, 3, 4, 5, 12, 13, 20, 21, 22, 23, 24, 25, 100, 153, 119, 76; 408/19; 409/163, 189, 197, 226, 903; 414/750, 753; 38/143; 112/65, 67, 108, 110, 113, 121.11, 121.15, 121.14, 121.29

[56] References Cited

U.S. PATENT DOCUMENTS

| | | | |
|---|---|---|---|
| 2,944,496 | 7/1960 | Gardner | 112/65 |
| 3,073,267 | 1/1963 | Reeber et al. | 112/121.11 |
| 3,082,719 | 3/1963 | Zeitlin | 112/65 |
| 3,878,801 | 4/1975 | Conner, Jr. | 112/121.29 |
| 3,964,661 | 6/1976 | Schmidt et al. | 227/119 |
| 4,067,277 | 1/1978 | Solomon et al. | 112/121.14 X |
| 4,173,191 | 11/1979 | Taddicken | 112/65 |
| 4,220,275 | 9/1980 | Hameter et al. | 227/5 |

*Primary Examiner*—Paul A. Bell

*Attorney, Agent, or Firm*—Frank C. Leach, Jr.

[57] ABSTRACT

An article is clamped in a predetermined position on a support, which is movable along a reciprocating path by a stepping motor. This movement of the support positions selected and spaced portions of the article at a fixed location at which a fastener element is attached to an edge of the article. The movement of the stepping motor is controlled by a computer program whereby the selected and spaced portions of the article are spaced from each other as desired.

27 Claims, 17 Drawing Figures

1A
1B

ARTICLE TRANSPORT APPARATUS

This invention relates to an article transport apparatus and, more particularly, to an article transport apparatus for positioning selected and spaced portions of an article at a fixed location in a selected order for processing.

Articles of clothing such as jackets, for example, are attached by fastener elements spaced along the length of each of two adjoining edges of the jacket. One edge of the jacket has fastener elements initially applied thereto by an operator at a fastener apparatus such as the type disclosed in U.S. Pat. No. 3,964,661 to Schmidt et al. After one edge of the jacket has the fastener elements arranged thereon at various selected, spaced distances, the operator must mark the other edge of the jacket in some manner to obtain positioning of the fastener elements on the other edge to correspond to the location of the fastener elements on the one edge. One means of doing this is to have the operator mark the fastener elements with chalk on the one edge of the jacket and overlie the other edge so as to have a chalk transfer mark at each location at which a fastener element is to be attached. Then, the operator must position the jacket manually with the other edge underneath a second fastener applying machine so that each of the fastener elements may be applied to the other edge of the jacket. The two fastener machines are required because the fastener element on one of the edges is the male member and the fastener element on the other edge is the female member.

If the operator fails to properly align each of the chalk locations on the other edge of the jacket, the fastener elements on the two edges of the jacket may not be properly aligned with each other relative to the adjacent fastener elements in either longitudinal direction. This can result in the jacket being unsatisfactory.

Furthermore, it is necessary for the application of the fastener elements to the one edge of the jacket to be properly located in the longitudinal direction relative to each other. Again, this is done by manual positioning by the operator of the jacket at each of the desired locations.

In addition to the problem of obtaining correct longitudinal alignment, this manual arrangement of attaching the fastener elements to the two edges of the jacket is relatively time consuming. This increases the cost of manufacturing the jacket.

The article transport apparatus of the present invention overcomes the disadvantages of the manual positioning of the jacket at a fastener apparatus of the type shown in the aforesaid Schmidt et al patent, for example. The article transport apparatus of the present invention automatically positions each portion of the one edge of the jacket to which a fastener element is to be attached at the correct location for the fastener element to be attached. Thus, precise location of said selected portion of the jacket at the fastener apparatus is obtained with the article transport apparatus of the present invention.

The other edge of the jacket has the same selected portions positioned at a second fastener apparatus to have the fastener elements attached thereto. Thus, each edge of the jacket has the fastener elements attached at the desired portions of the jacket and precisely aligned with each other. Therefore, there is no possibility of a jacket being unsatisfactory because of the fastener elements not being properly aligned with each other on the two edges of the jacket.

The article transport apparatus of the present invention accomplishes this precise positioning of the fastener elements on the two edges of the jacket be precisely positioning one edge of the jacket on a support, which is moved under control of a computer program to position each of the selected, spaced portions of the jacket at the fastener apparatus in a selected order. This same program would then be utilized with a second article transport apparatus of the present invention to attach the fastener elements to the opposite edge of the jacket.

An object of this invention is to provide an article transport apparatus for positioning selected, spaced portions of an article at a fixed location in a selected order of movement.

Another object of this invention is to provide an article transport apparatus in which each of a plurality of selected, spaced portions of an article is precisely positioned at a fixed location.

A further object of this invention is to provide an article transport apparatus in which the spacing between the selected portions of an article to be disposed at a fixed location may be easily and quickly changed.

Other objects of this invention will be readily perceived from the following description, claims, and drawings.

This invention relates to an article transport apparatus for positioning various selected and spaced portions of an article at a fixed location in a selected order including support means to support an article having selected and spaced portions for positioning at a fixed location in a selected order and clamping means to clamp the article on the support means in a fixed relation to a predetermined location on the support means. Moving means moves the support means along a predetermined reciprocating path relative to a fixed location during a cycle of operation. First causing means causes activation of the moving means and second causing means causes inactivation of the moving means when each selected portion of the article to be disposed at the fixed location is disposed at the fixed location by the moving means. Processing means perform a process on each of the selected portions of the article when the selected portion of the article is disposed at the fixed location and the moving means is inactivated. The first causing means is activated by activating means after each of the selected portions of the article has been disposed at the fixed location and subjected to the process by the processing means. Means renders the clamping means ineffective when movement of the support means by the moving means is completed during a cycle of operation.

The attached drawings illustrate a preferred embodiment of the invention, in which.

Figures 1, 1A, 8, 15:
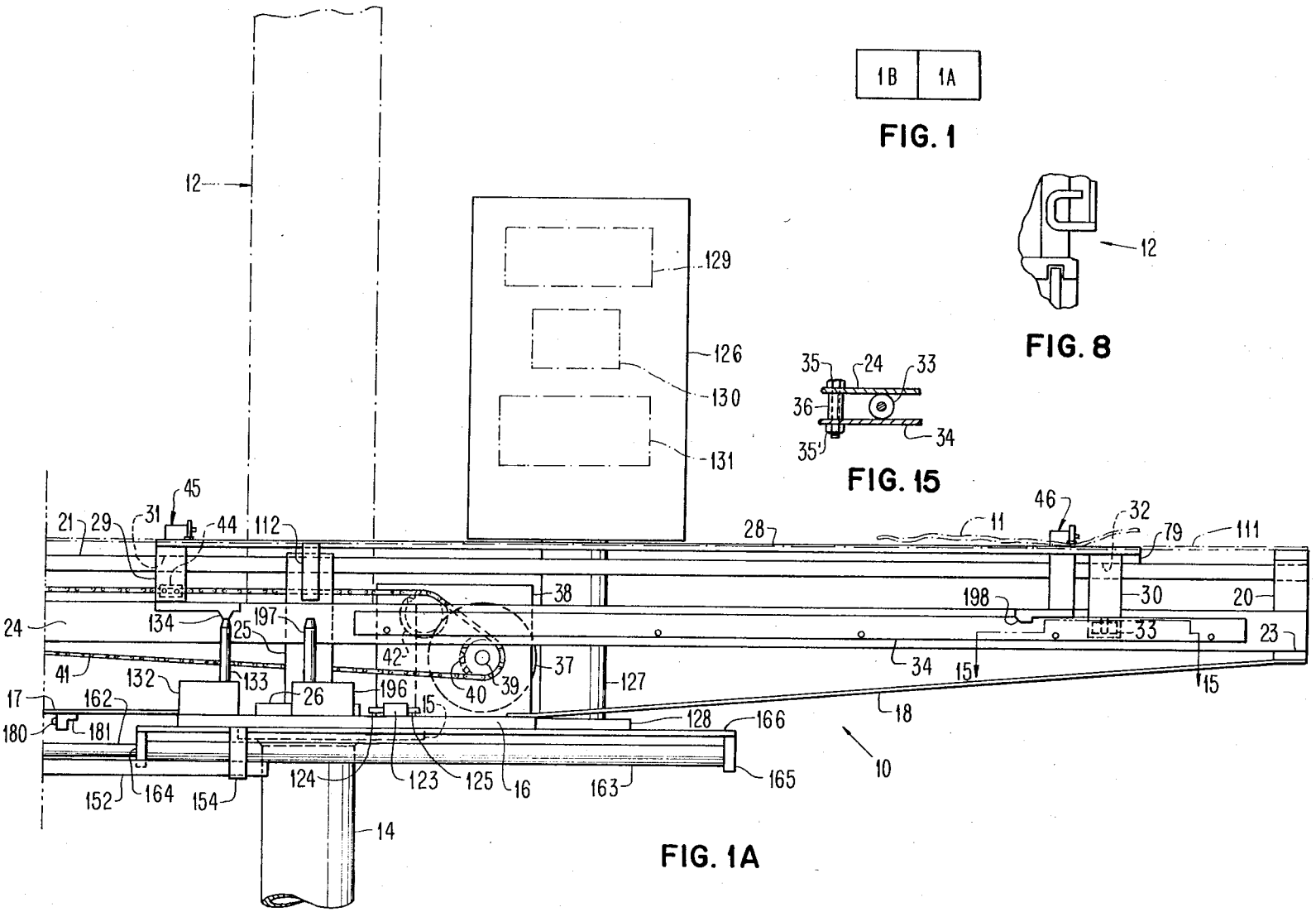
FIG. 1 is a block diagram showing the relationship of FIGS. 1A and 1B.
FIG. 1A is a front elevational view of a right portion of an article transport apparatus of the present invention with a fastener apparatus for use therewith being shown in phantom.
FIG. 8 is a fragmentary side elevational view of a portion of the fastener apparatus in which the fasteners are attached to the article.
FIG. 15 is a sectional view of a portion of the article transport apparatus of FIG. 1 and taken along line 15—15 of FIG. 1A.
Figure 1B:
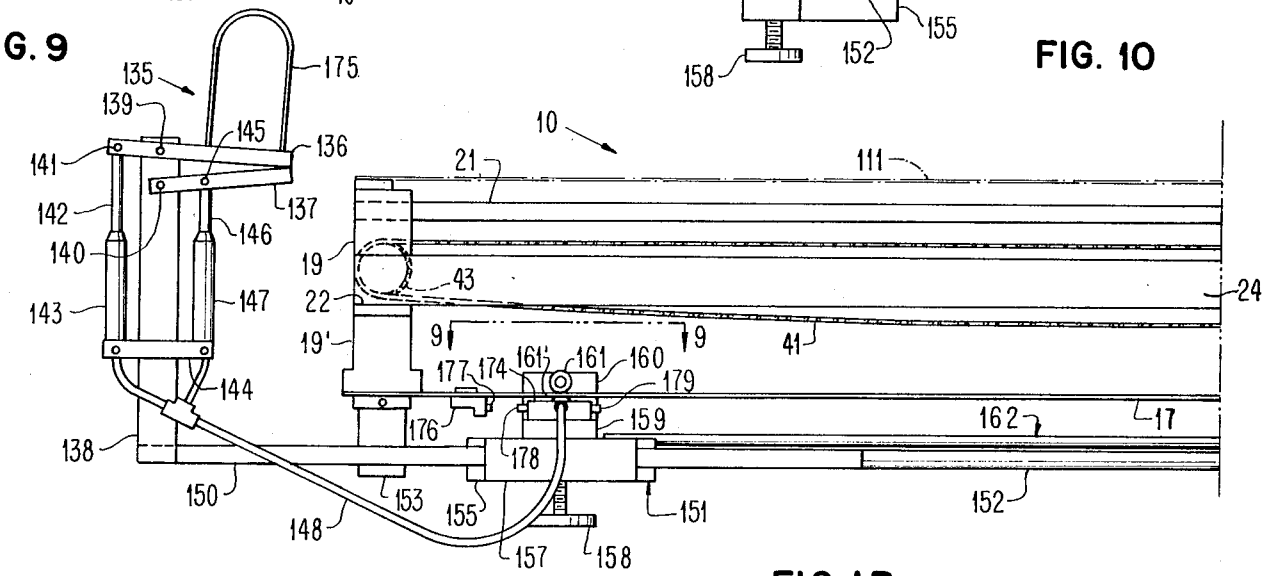
FIG. 1B is a front elevational view of the left and remaining portion of the article transport apparatus not shown in FIG. 1A.

Referring to the drawings and particularly FIGS. 1A and 1B, there is shown an article transport apparatus 10 for positioning an article 11 such as a jacket, for example, at a fixed location at which fastener elements may be attached to selected and spaced portions of each edge of the article 11 by a fastener apparatus 12, which is shown in phantom. One suitable example of the fastener apparatus 12 is an apparatus shown and described in the aforesaid Schmidt et at patent, which is incorporated by reference herein, and sold as Model No. 2 by Universal Fastener Company, Lawrenceburg, Ky.

The article transport apparatus 10 includes a vertical support post 14, which rests on the floor. The vertical support post 14 has a base plate 15 attached to its upper end by suitable means such as welding, for example. The front portion of the base plate 15 supports a plate 16. Support bars 17 and 18 extend outwardly from opposite sides of the plate 16 with the bars 17 being horizontal and the bar 18 extending upwardly at an angle from the plate 16.

The bar 17 has a bracket 19 supported on its end by a spacer 19' extending upwardly therefrom. The end of the bar 18 has a bracket 20 secured thereto by suitable means such as screws, for example, and extending upwardly therefrom. The brackets 19 and 20 have a shaft 21 supported by the brackets 19 and 20 in fixed relation thereto and extending therebetween. The spacer 19' is used to dispose the openings in the brackets 19 and 20 for the shaft 21 in the same horizontal plane.

The brackets 19 and 20 have recesses 22 and 23, respectively, therein to receive the ends of a plate 24, which is rectangular shaped in cross section. The plate 24 is fixed to the brackets 19 and 20 by suitable means such as screws, for example.

Figure 6:
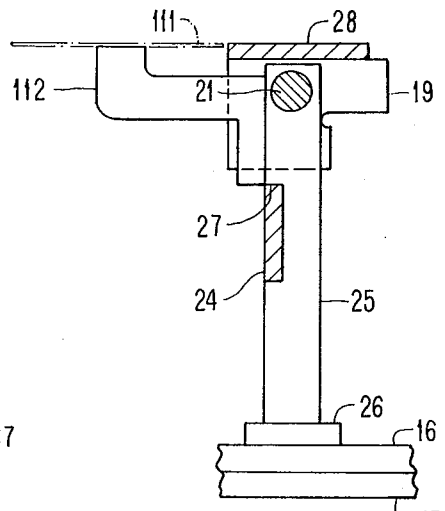
FIG. 6 is a side elevational view, partly in section, of a portion of the article transport apparatus of FIG. 1A.

The shaft 21 is supported intermediate its ends in the upper end of a center post 25, which has its base 26 attached to the plate 16 by suitable means such as screws, for example. The center post 25 has a recess 27 (see FIG. 6) therein to receive the plate 24, which is attached to the center post 25 by suitable means such as screws, for example.

Thus, the shaft 21, the plate 24, the brackets 19 and 20 (see FIG. 1A), and the center post 25 constitute a stationary frame on which a table 28 is slidably supported. The table 28 has a block 29 fixed to its left end by any suitable means such as screws, for example. The table 28 has a sliding block 30 mounted adjacent its other end and releasably connected thereto.

The blocks 29 and 30 have passages 31 and 32, respectively, to receive the shaft 21 so that the blocks 29 and 30 are slidably mounted on the shaft 21. Thus, the table 28 can be moved relative to the shaft 21 along the longitudinal axis of the shaft 21.

The block 30 has a roller 33, which is rotatable about a vertical axis, on its end and disposed between the plate 24 and a guide bar 34, which is fixed to the plate 24 by bolts 35 (see FIG. 15) and nuts 35' and held in spaced relations thereto by spacers 36. This arrangement prevents any rotation of the table 28 (see FIG. 1A) about the shaft 21.

The table 28 is moved along the longitudinal axis by a stepping motor 37, which is supported on a motor mount 38. The motor mount 38 extends upwardly from the plate 16 and is fixed thereto by suitable means such as screws, for example.

The motor 37 has its shaft 39 extending horizontally therefrom with a sprocket 40 fixed to the shaft 39 for rotation therewith. A chain 41 passes around an idler sprocket 42, which is rotatably supported by the motor mount 38, and then around an idler sprocket 43 (see FIG. 1B), which is rotatably supported by the bracket 19 on the opposite side thereof from the recess 22.

The chain 41 is attached to the table 28 (see FIG. 1A) through a chain clamp 44 being connected to the block 29, which extends downwardly from the lower surface of the table 28. Accordingly, the amount of motion of the table 28 in either direction is dependent upon the amount of rotation of the stepping motor 37. Therefore, very precise positioning of the table 28 relative to the fastener apparatus 12 is obtainable with the stepping motor 37.

Figure 2:
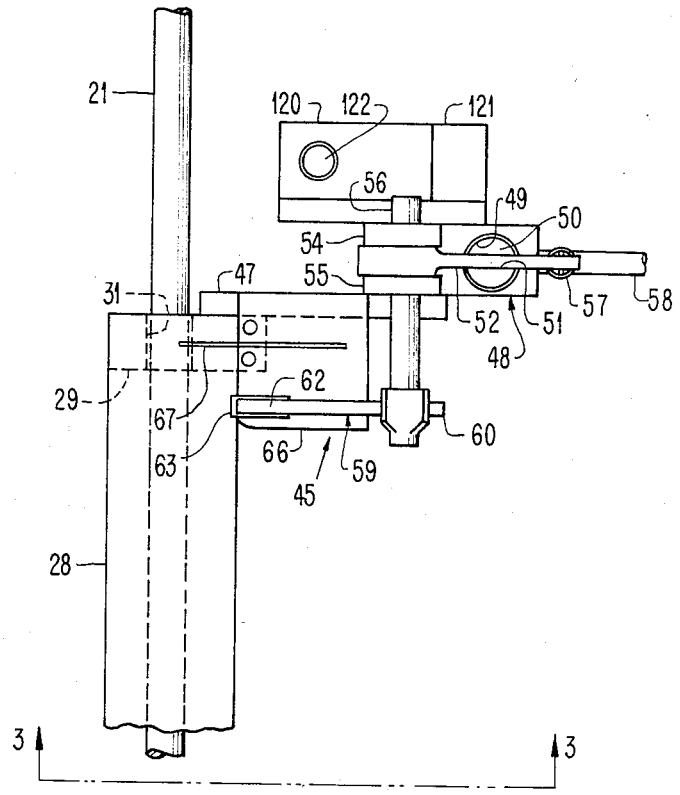
FIG. 2 is a top plan view of a portion of the article transport apparatus of FIG. 1A and showing a clamping mechanism for holding one portion of the article to be transported past the fastener apparatus.
Figure 3:
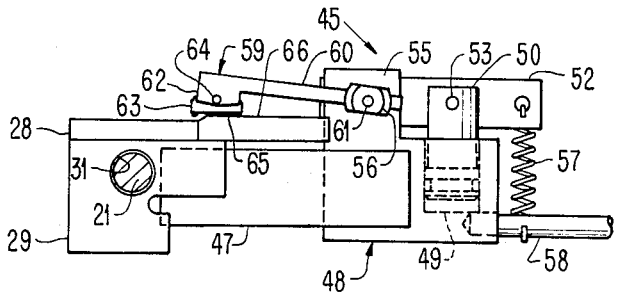
FIG. 3 is an end elevational view, partly in section, of the article transport apparatus and the clamping mechanism of FIG. 3 and taken along line 3—3 of FIG. 2.

The article 11 is held on the table 28 by a clamping mechanism 45 adjacent the end having the block 29 attached thereto and a clamping mechanism 46 movable with the block 30. As shown in FIGS. 2 and 3, the clamping mechanism 45 includes a mount 47, which is attached to the side of the block 29 by suitable means such as screws, for example. The mount 47 has an L-shaped cylinder block 48 attached thereto by suitable means such as screws, for example.

The cylinder block 48 has a cylinder 49 therein within which a piston 50 is slidably mounted. The piston 50 has its upper end bifurcated to form a slot 51 to receive a lever 52, which is connected to the piston 50 by a pin 53.

The lever 52 extends between a pair of upstanding portions 54 and 55 of the cylinder block 48. The lever 52 has a shaft 56, which is rotatably supported in the upstanding portions 54 and 55 of the cylinder block 48, extending therethrough and secured thereto by suitable means. Thus, the shaft 56 is rotatable about its axis by movement of the lever 52.

The lever 52 is biased clockwise (as viewed in FIG. 3) about the pin 53 by a spring 57, which has one end secured to the lever 52 and its other end attached to a pipe 58. The pipe 58 is fixed to the cylinder block 48 and supplies pressurized air to the cylinder 49. Thus, when pressurized air is supplied through the pipe 58, the piston 50 is pushed out of the cylinder 49 in the cylinder block 48 to cause the shaft 56 to be rotated counterclockwise.

The shaft 56 has a presser foot 59 secured thereto. The presser foot 59 includes a circular rod 60 extending through a circular passage in the shaft 56 and secured to the shaft 56 by a set screw 61 (see FIG. 3).

The presser foot 59 also has a bifurcated end 62 to receive a clamping element 63 therein. The clamping element 63 is pivotally connected by a pivot pin 64 to the bifurcated end 62 of the presser foot 59. The clamping element 63 has projections 65 (see FIG. 3) on its base for engaging the article 11 (see FIG. 1A) to retain it against the upper surface of an extension table 66 (see FIG. 3). The extension table 66, which is thicker than the table 28, is attached to the block 29 on the table 28 by suitable means such as screws, for example.

Accordingly, when pressurized air is supplied through the pipe 58 to raise the piston 50 to cause pivoting of the lever 52 whereby the shaft 56 rotates counterclockwise (as viewed in FIG. 3), the presser foot 59 rotates with the shaft 56 so that the projections 65 on the clamping element 63 hold the article 11 (see FIG. 1A) against the upper surface of the extension table 66 (see FIG. 2).

The extension table 66 includes a mark 67 to enable the article 11 (see FIG. 1A) to have one end disposed at a predetermined position. The mark 67 (see FIG. 2) also extends to the table 28.

When pressurized air is vented from the pipe 58, the spring 57 causes pivoting of the lever 52 to rotate the shaft 56 clockwise (as viewed in FIG. 3). This withdraws the projections 65 on the clamping element 63 from engagement with the article 11 (see FIG. 1A) to enable the article 11 to be removed.

Figure 4:
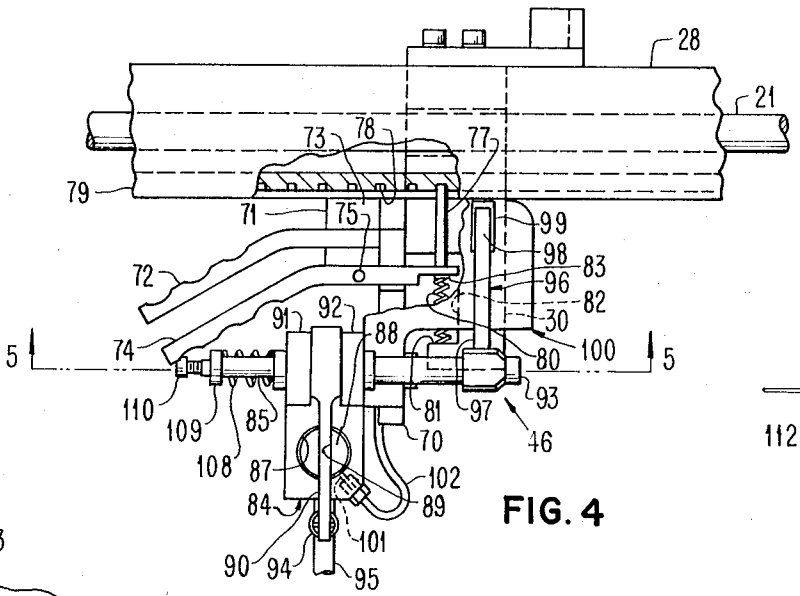
FIG. 4 is a fragmentary top plan view, partly in section, of a portion of the article transport apparatus of FIG. 1A and showing a portion of another clamping mechanism for holding another portion of the article to be transported past the fastener apparatus.

The clamping mechanism 46 is adjustable with the sliding block 30 relative to the length of the table 28 in accordance with the length of the article 11 to be clamped by the clamping mechanisms 45 and 46. As shown in FIG. 4, the clamping mechanism 46 includes a mount 70, which is attached to the sliding block 30 by suitable means such as screws, for example. The mount 70 has a pivot block 71 fixed thereto by suitable means such as screws, for example.

The pivot block 71 has a stationary handle 72 attached to an end surface of an upstanding portion 73 of the pivot block 71 by suitable means such as screws, for example. A release lever 74 is pivotally mounted on the pivot block 71 by a pivot pin 75. Thus, grasping of the stationary handle 72 and pulling the release lever 74 towards the stationary handle 72 results in the release lever 74 pivoting clockwise about the pivot pin 75.

The release lever 74 has a passage through which a location pin 77 extends. The location pin 77 has one end disposed in one of a plurality of longitudinally spaced recesses 78 in a channel bar 79, which is fixed to the table 28 by suitable means such as screws, for example. The location pin 77 is resiliently urged towards the channel bar 79 by a spring 80, which is disposed between a flange 81 of a L-shaped block 82 and a head 83 of the location pin 77. The block 82 is fixed to the block 30 by suitable means such as screws, for example. The head 83 of the location pin 77 has one side subjected to one end of the spring 80 and the release lever 74 acting against the outer side. Therefore, when the release lever 74 is pivoted clockwise about the pivot pin 75, the location pin 77 is withdrawn from one of the recesses 78 and the clamping mechanism 46 and the block 30 can be moved relative to the table 28.

The clamping mechanism 46 includes an L-shaped cylinder block 84, which is slidably mounted on a pair of guide rods 85 (see FIG. 5) secured to the mount 70 by nuts 86 cooperating with threaded ends of the guide rods 85. The cylinder block 84 has a cylinder 87 (see FIG. 4) therein within which a piston 88 is slidably mounted. The piston 88 has its upper end bifurcated to form a slot 89 to receive a lever 90, which is connected to the piston 88 by a pin (not shown) in the same manner as the piston 50 (see FIG. 3) is connected to the lever 52 by the pin 53.

The lever 90 (see FIG. 4) extends between a pair of upstanding portions 91 and 92 of the cylinder block 84. The lever 90 has a shaft 93, which is rotatably supported in the upstanding portions 91 and 92 of the cylinder block 84, extending therethrough and secured thereto by suitable means. Thus, the shaft 93 is rotatable about its axis by movement of the lever 90.

The lever 90 is biased in one direction about its pin connecting the lever 90 to the piston 88 by a spring 94, which has one end secured to the lever 90 and its other end attached to a pipe 95. The pipe 95 is fixed to the cylinder block 84 and supplies pressurized air to the cylinder 87. Thus, when pressurized air is supplied through the pipe 95, the piston 88 is pushed upwardly out of the cylinder 87 in the cylinder block 84 to cause the shaft 93 to be rotated.

The shaft 92 has a presser foot 96 secured thereto. The presser foot 96 includes a circular rod 97 extending through a circular passage in the shaft 93 and secured to the shaft 93 by a set screw in the same manner as the circular rod 60 (see FIG. 3) of the presser foot 59 is secured to the shaft 56 by the set screw 61.

The presser foot 96 (see FIG. 4) also has a bifurcated end 98 to receive a clamping element 99 therein. The clamping element 99 is pivotally connected to the bifurcated end 98 of the presser foot 96 in the same manner as the clamping element 63 (see FIG. 3) is pivotally connected to the bifurcated end 62 of the presser foot 59 by the pivot pin 64. The clamping element 99 (see FIG. 4) also has projections on its base for engaging the article 11 (see FIG. 1A) to retain it against the upper surface of a support 100 in the same manner as the projections 65 (see FIG. 3) on the base of the clamping element 63 engage the article 11 (see FIG. 1A) to retain it against the upper surface of the extension table 66 (see FIG. 3). The support 100 (see FIG. 4) is fixed to the cylinder block 84 for movement therewith by suitable means such as screws, for example.

Accordingly, when pressurized air is supplied through the pipe 95 to raise the piston 88 to cause pivoting of the lever 90 whereby the shaft 93 is rotated, the presser foot 96 rotates with the shaft 93 so that the projections on the clamping element 99 hold the article 11 (see FIG. 1A) against the upper surface of the support 100 (see FIG. 4).

As the piston 88 moves upwardly, it uncovers a vent passage 101 in the cylinder block 84 to enable pressurized air to flow through a hose 102 to a passage 103 (see FIG. 5) in a piston 104, which is fixed to the mount 70. The piston 104 is disposed within a passage 105 in the cylinder block 84. Thus, pressurized air is supplied through the passage 103 and a communicating longitudinal passage 106 in the piston 104 to act on a spring plate 107, which is disposed in one end of the passage 105 in the cylinder block 84 to close it and is fixed to the cylinder block 84.

Figure 5:
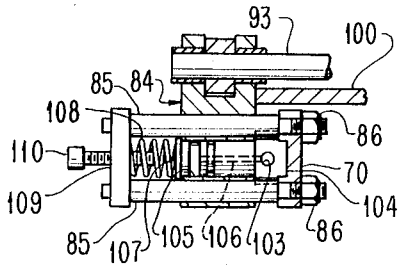
FIG. 5 is a fragmentary sectional view of a portion of the clamping mechanism of FIG. 4 and taken along line 5—5 of FIG. 4.

Therefore, since the piston 104 is fixed to the mount 70, the pressurized air causes the cylinder block 84 to move to the left in FIG. 5 against the force of a spring 108, which is held between the spring plate 107 and a stop plate 109, which is mounted on the guide rods 85. The force of the spring 108 is adjustable by a screw 110, which is mounted in the stop plate 109 and engages the spring plate 107 when the cylinder block 84 is moved to the left in FIG. 5.

Accordingly, shifting of the cylinder block 84 away from the sliding block 30 (see FIG. 4) causes tightening of the article 11 (see FIG. 1A) held by the clamping mechanisms 45 and 46. This insures that the article 11 is taut when the fastener elements are attached thereto by the fastener apparatus 12 so that the fastener elements are disposed at the correct locations.

When pressurized air is vented from the pipe 95 (see FIG. 4), pressurized air is vented from the passage 105 (see FIG. 5) in the cylinder block 84 through the passages 106 and 103 in the piston 104 and the hose 102 (see FIG. 4) to initially enable the cylinder block 84 to be moved by the spring 108 towards the sliding block 30 and the clamping mechanism 45 (see FIG. 1A). Further downward motion of the piston 88 (see FIG. 4) by the spring 94 blocks the vent passage 101 in the cylinder block 84 but allows continued pivoting of the lever 90 to rotate the shaft 93 in the opposite direction from that in which it was rotated when pressurized air was supplied through the pipe 95. Accordingly, the projections on the clamping element 99 are withdrawn from engagement with the article 11 (see FIG. 1A) to enable the article 11 to be removed. Of course, this venting of pressurized air from the cylinder 87 (see FIG. 4) in the cylinder block 84 occurs at the same time that pressurized air is vented from the cylinder 49 (see FIG. 3) in the cylinder block 48 of the clamping mechanism 45.

After the clamping mechanism 46 (see FIG. 1A) is positioned at the desired location along the table 28, the article 11 is disposed with its upper edge aligned with the mark 67 (see FIG. 2) on the extension table 66. In addition to being supported on the table 28 and the extension table 66, the article 11 (see FIG. 1A) also partially rests on a cover 111, which is releasably secured to the upper ends of the brackets 19 (see FIG. 1B) and 20 (see FIG. 1A) for support and extends towards the operator. The cover 11 also is supported on the center post 25 by a Z-shaped support 112 (see FIG. 6).

Then, a switch 120 (see FIG. 2), which is mounted on an L-shaped support 121, is closed by pressing a push button 122 of the switch 120. The L-shaped support 121 is attached to the cylinder block 48 by suitable means such as screws, for example.

Depression of the push button 122 results in pressurized air being supplied from a source through a connector 123 (see FIG. 1A), which is supported on the plate 16. The connector 123 has a first hose 124 extending therefrom to the pipe 58 (see FIG. 3) to move the piston 50 upwardly in the cylinder 49 to cause the presser foot 59 to be moved so that the projections 65 engage the article 11 (see FIG. 1A) against the upper surface of the extension table 66 (see FIG. 3). A second hose 125 (see FIG. 1A) extends from the connector 123 to the pipe 95 (see FIG. 4) to supply air to the cylinder 87 in the cylinder block 84 of the clamping mechanism 46 to cause clamping of the article 11 (see FIG. 1A) against the support 100 (see FIG. 4) and shifting of the cylinder block 84 after clamping of the article 11 (see FIG. 1A).

Figure 12:
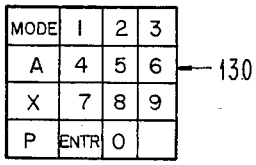
FIG. 12 is a front elevational view of a plurality of push buttons employed with the control box of the article transport apparatus of FIG. 1A.

The activation of the push button 122 (see FIG. 2) to close the switch 120 sends a signal to a computer within a control box 126 (see FIG. 1A), which is supported by the plate 16 in spaced relation thereto through a post 127 and a plate 128, which supports the post 127 and is fixed to the plate 16. The control box 126 has a display 129, a plurality of push buttons 130, and a panel 131 thereon. One suitable example of the computer is sold by Eastlex Machine Corporation, Lexington, Ky. as Indexer Control Model No. 9. The push buttons 130 (see FIG. 12) include MODE A, X, P, ENTR, 0, 1, 2, 3, 4, 5, 6, 7, 8, and 9 push buttons.

When the push button 122 (see FIG. 2) is activated, the table 28 (see FIG. 1A) must be in its home position. This is when a microswitch 132, which is supported on the plate 16, has a stem 133 engaged by a switch actuator 134. The switch actuator 134 is secured to the bottom of the block 29.

Figure 14:
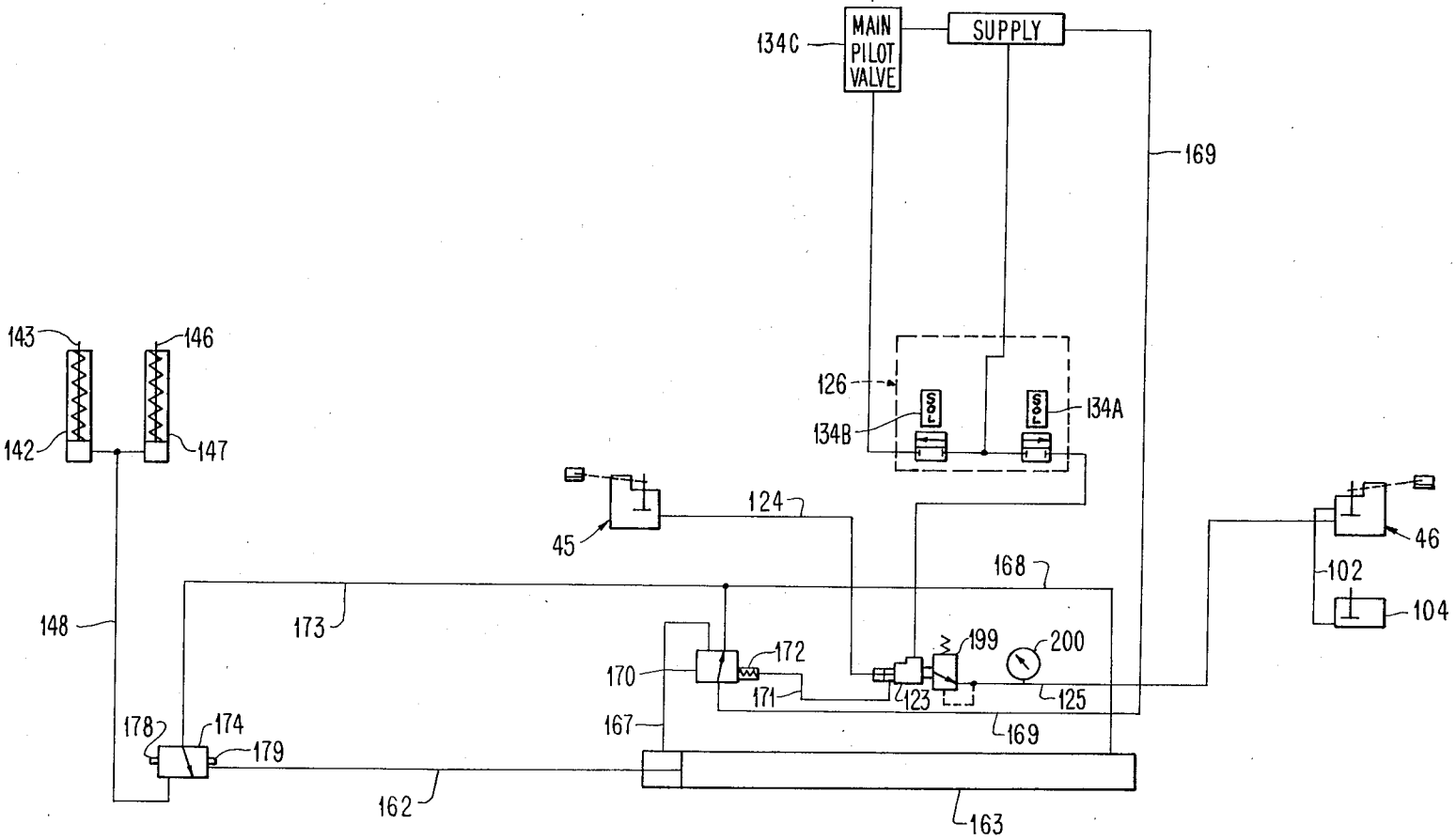
FIG. 14 is a schematic diagram of a pressurized air system for controlling various movements of various portions of the article transport apparatus of the present invention.

When the table 28 is in its home position so that the stem 133 of the microswitch 132 is engaged by the switch actuator 134, depression of the push button 122 (see FIG. 2) starts a cycle of operation through activating one of the programs of the computer within the control box 126 (see FIG. 1A). This initially causes opening of a solenoid valve 134A (see FIG. 14) to allow pressurized air to flow through the hoses 124 and 125 to the clamping mechanisms 45 and 46 to clamp the article 11 (see FIG. 1A) in the desired position.

After a time delay, the motor 37 is energized to move the table 28 to the right in FIG. 1A so that the fastener apparatus 12 can attach a fastener to the upper end of one edge of the article 11 when it is a jacket, for example. When the motor 37 has moved the table 28 the desired distance from the home position to the right in FIG. 1A, the motor 37 stops.

After the motor 37 stops, a signal is transferred from the program of the computer in the control box 126 to open a second solenoid valve 134B (see FIG. 14) to allow pressurized air to be supplied through a main pilot valve 134C of the fastener apparatus 12 (see FIG. 1A) to air cylinders of the fastener apparatus 12 to cause fastening elements to be attached to opposite sides of one edge of the jacket in the manner more particularly shown and described in the aforesaid Schmidt et al patent. Upon return of the pistons of the fastener apparatus 12 to their home positions at completion of attachment of a fastener element to the edge of the jacket, an electric switch is activated to indicate this to the program of the computer within the control box 126. This results in activation of the motor 37 to advance the table 28 to the next position at which fastening of the fastener elements by the fastener apparatus 12 is to occur. The program of the computer within the control box 126 controls the amount of movement of the stepping motor 37 to move the table 28 to the various positions to dispose selected spaced portions of the article 11 for attachment of the fastener elements by the fastener apparatus 12 to the article 11.

At completion of fastening at the last position for which the program of the computer within the control box 126 is programmed, the table 28 is returned to the home position in which the stem 133 of the microswitch 132 is engaged by the switch actuator 134 on the block 29. The closing of the microswitch 132 transmits a signal to the computer within the control box 126 to cause closing of the solenoid valve 134A (see FIG. 14), which allows pressurized air to be supplied through the hoses 124 and 125 when open. This releases the clamping mechanism 45 and 46 so that the article 11 (see FIG. 1A) is no longer held in the clamped position and can be removed.

When the clamping mechanisms 45 and 46 are released, it is necessary for the operator to grasp the article 11 or it would fall to the floor. To avoid the necessity of the operator having to manually hold the article 11 prior to its release from the clamping mechanisms 45 and 46, a gripper 135 (see FIG. 1B) may be employed. The gripper 135 is capable of holding the article 11 (see FIG. 1A) when the clamping mechanisms 45 and 46 are released, and it also is capable of transporting, if desired, the article 11 to a position where the article 11 may fall by gravity into a container (not shown) in which the articles 11 may be collected.

Since different fastener elements must be employed for opposite edges of the jacket to which the fastener elements are being attached by the fastener apparatus 12, another of the article transport apparatuses 10 must be utilized. One of the fastener elements is a male fastener element and the other is a female fastener element.

When using the two article transport apparatuses 10 with one having the fastener apparatus 12 apply the male fastener element and the other of the article transport apparatuses 10 having the fastener apparatus 12 apply the female fastener element, the gripper 135 (see FIG. 1B) of the article transport apparatus 10 in which the fastener element is initially applied to one edge of the jacket would have the gripper 135 merely hold the article 11 (see FIG. 1A) when the clamping mechanisms 45 and 46 are released. When the other of the two fastener elements is applied to the other edge of the jacket, the gripper 135 (see FIG. 1B), which is used with the article transport apparatus 10 applying the second of the two fastener elements, would be employed to transport the article 11 (see FIG. 1A) a selected distance away from the article transport apparatus 10 to enable the article 11 to be deposited in a container (not shown).

The gripper 135 (see FIG. 1B) includes an upper finger 136 and a lower finger 137 movable towards and away from each other. The upper finger 136 is pivotally mounted on a post 138 by a pivot pin 139, and the lower finger 137 is pivotally mounted on the post 138 by a pivot pin 140.

One end of the upper finger 136 is pivotally connected by a pivot pin 141 to the upper end of a piston rod 142 of an air cylinder 143, which is supported by a mount 144 on the post 138. The lower finger 137 is pivotally connected intermediate its ends by a pivot pin 145 to the uper end of a piston rod 146 of an air cylinder 147, which also is supported by the mount 144.

The air cylinders 143 and 147 have the piston rods 142 and 146, respectively, moved upwardly therefrom when pressurized air is supplied to the air cylinders 143 and 147 through a hose 148 (This is the position shown in FIG. 1B.). When the pressurized air is vented from the air cylinders 143 and 147, springs (not shown) in the air cylinders 143 and 147 retract the piston rods 142 and 146, respectively. Thus, pressurized air supplied through the hose 148 to the air cylinders 143 and 147 causes the fingers 136 and 137 to move to the gripping position of FIG. 1B whereas venting of the pressurized air in the air cylinders 143 and 147 enables the springs (not shown) in the air cylinders 143 and 147 to move the fingers 136 and 137 apart to release the article 11 (see FIG. 1A) held therebetween. One suitable example of the air cylinders 143 (see FIG. 1B) and 147 is an air cylinder sold by Humphrey Products, Kalamazoo, Mich. as model 8SP-1/2.

The post 138 is fixed to one end of a square-shaped bar 150 by suitable means such as screws, for example. The bar 150 is adjustably mounted in a support body 151 for sliding movement in the horizontal direction relative thereto. The support body 151 is slidable along a fixed, circular guide rod 152.

One end of the guide rod 152 is supported in a mount 153, which extends downwardly from the bottom surface of the bar 17 to which it is secured by suitable means such as screws, for example. The guide rod 152 is fixed to the mount 153. The other end of the guide rod 152 is supported in a mount 154 (see FIG. 1A), which is secured by suitable means such as screws, for example, to the bottom surface of the plate 16. The guide rod 152 is fixed to the mount 154.

The support body 151 (see FIG. 1B) includes a slide 155, which has the guide rod 152 pass therethrough so that the slide 155 is slidably mounted thereon, and a C-shaped clamp block 157, which is fixed to the front of the slide 155 by suitable means such as screws, for example. The C-shaped clamp block 157 has a locking screw 158 bearing against the lower surface of the square-shaped bar 150 to retain the bar 150 in any position to which the bar 150 is adjusted relative to the support body 151.

Figure 10:
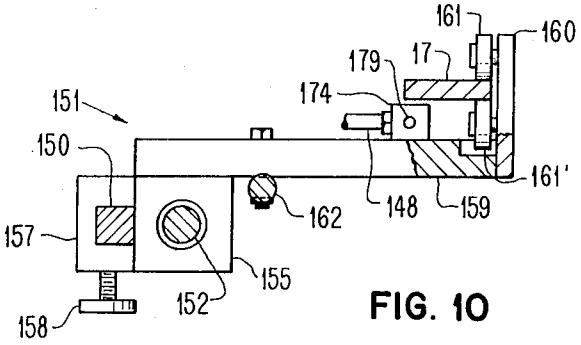
FIG. 10 is a sectional view of the portion of the article transport apparatus shown in FIG. 9 and taken along line 10—10 of FIG. 9.

The support body 151 also includes a rectangular shaped slide bar 159, which is attached to the top of the slide 155 by suitable means such as screws, for example. The rear of the slide bar 159 has a bracket 160 secured thereto and extending upwardly therefrom. The upper end of the bracket 160 has a roller 161 rotatably mounted thereon for riding along the upper surface of the bar 17 and a roller 161' (see FIG. 10) rotatably mounted thereon for riding along the lower surface of the bar 17. Thus, the support body 151 is slidable along the guide rod 152 and has its direction of movement along the longitudinal axis of the guide rod 152 further controlled through the rollers 161 and 161' riding on opposite sides of the bar 17.

Figure 9:
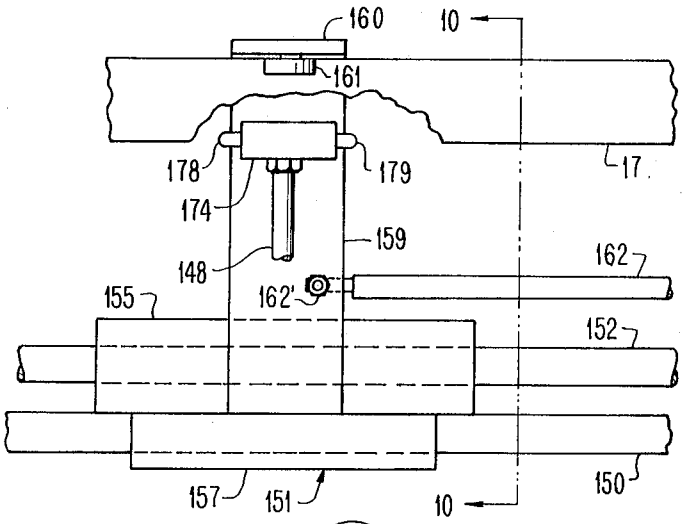
FIG. 9 is a fragmentary top plan view of a portion of the article transport apparatus of FIG. 1B and taken along line 9—9 of FIG. 1B.

The support body 151 is movable along the guide rod 152 by a piston rod 162, which is fixed to the upper surface of the slide bar 159 by a rod end bearing 162' (see FIG. 9), of an air cylinder 163 (see FIG. 1A). Therefore, retraction and extension of the piston rod 162 of the air cylinder 163 controls movement of the bar 150 (see FIG. 1B) and the gripper 135 attached thereto.

The air cylinder 163 (see FIG. 1A) is supported in a pair of mounts 164 and 165, which are secured to opposite ends of a horizontal plate 166. The plate 166 is attached by suitable means such as screws, for example, to the bottom surface of the plate 16. Thus, the air cylinder 163 is fixed against movement.

The air cylinder 163 always has air supplied to one of its ends through one of a pair of hoses 167 (see FIG. 14) and 168. When pressurized air is supplied through the hose 167, the piston rod 162 is retracted while the supply of pressurized air through the hose 168 causes extension of the piston rod 162.

Pressurized air is supplied from a source through a hose 169 to a four-way valve 170. One suitable example of the four-way valve 170 is sold by Clippard Instrument Laboratory, Inc., Cincinnati, Ohio as model MAV4IN.

Whenever the clamping mechanisms 45 (see FIG. 1A) and 46 have pressurized air supplied thereto through the hoses 124 and 125, respectively, to have the clamping mechanisms 45 and 46 clamp the article 11, pressurized air also is supplied through a hose 171 (see FIG. 14) to act on a pilot activator 172, which controls the four-way valve 170 so that pressurized air from the supply hose 169 is supplied to the hose 167. This retracts the piston rod 162 into the air cylinder 163. One suitable example of the pilot activator 172 is a pilot activator sold by Clippard Instrument Laboratory, Inc., Cincinnati, Ohio as model MPA-3.

When pressurized air is vented from the hoses 124 and 125 so that the clamping mechanisms 45 (see FIG. 1A) and 46 are not holding the article 11, the spring within the four-way valve 170 (see FIG. 14) causes the pressurized air from the supply hose 169 to be supplied through the hose 168 to extend the piston rod 162 from the air cylinder 163.

The hose 168 has a hose 173 communicating therewith and with a four-way valve 174, which is mounted on the bracket 160 (see FIG. 1B). One suitable example of the valve 174 is sold by Clippard Instrument Laboratory, Inc., Cincinnati, Ohio as model MAV-4DIN.

The pressurized air in the hose 173 (see FIG. 14) passes through the valve 174 to the hose 148 because of the position of the valve 174. This causes the piston rods 142 (see FIG. 1B) and 146 of the air cylinders 143 and 147, respectively, to be extended whereby the fingers 136 and 137 of the gripper 135 are moved into engagement with each other to grasp the article 11 (see FIG. 1A), which has previously been held by the clamping mechanisms 45 and 46. It should be understood that the fingers 136 (see FIG. 1B) and 137 are spaced apart when the piston rods 142 and 146 of the air cylinders 143 and 147, respectively, are retracted so that the article 11 (see FIG. 1A) will enter between the fingers 136 (see FIG. 1B) and 137 as it is moved past the fastener apparatus 12 (see FIG. 1A) by the table 28 being moved through the stepping motor 37.

Accordingly, the article 11 is grasped by the fingers 136 (see FIG. 1B) and 137 at the time that it is released from the clamping mechanism 45 (see FIG. 1A) and 46. The upper finger 136 (see FIG. 1B) has a U-shaped element 175 extending from its upper surface to prevent the article 11 (see FIG. 1A) from hanging on the upper finger 136 (see FIG. 1B).

While the piston rod 162 is always extended the same maximum distance from the air cylinder 163 (see FIG. 1A), the extended position of the gripper 135 (see FIG. 1B) is determined by the position of the bar 150 within the support body 151. That is, as the bar 150 is pulled to the left in FIG. 1B from the support body 151 when the locking screw 158 is released, the amount of movement of the gripper 135 away from the clamping mechanisms 45 (see FIG. 1A) and 46 is increased for the same maximum extension of the piston rod 162 from the air cylinder 163.

When the article 11 is to be released to fall by gravity into a container, pressurized air within the hose 148 (see FIG. 14) must be vented at the time of completion of extension of the piston rod 162 from the air cylinder 163 to enable the fingers 136 (see FIG. 1B) and 137 to be moved apart. Accordingly, a stop 176 is adjustably mounted on the bar 17. The stop 176 has a projection 177 to engage a projection 178 on the valve 174. When this occurs, the valve 174 has its position changed so that pressurized air in the hose 148 is vented even though pressurized air is still being supplied through the hose 173 (see FIG. 14).

However, if the article 11 (see FIG. 1A) is to be transferred by the operator to a second of the article transport apparatuses 10 to have the fastener apparatus 12 apply the second of the fastener elements to the opposite edge, then it is not desired for the fingers 136 (see FIG. 1B) and 137 to be moved apart. Accordingly, the stop 176 is moved along the bar 17 so that the projection 177 on the stop 176 does not engage the projection 178 on the valve 174 at the maximum extension of the piston rod 162 from the air cylinder 163 (see FIG. 1A). As a result, pressurized air is maintained within the hose 148 (see FIG. 1B) to hold the fingers 136 and 137 in a gripping position.

This is because it is not desired for the article 11 (see FIG. 1A) to be released automatically because it will not be falling by gravity into a container. Instead, it is desired for the article 11 to be held by the gripper fingers 136 (see FIG. 1B) and 137 until the operator wishes to place the article 11 (see FIG. 1A) on the second of the article transport apparatuses 10 to have the other fastener element applied to the other edge.

It should be understood that the operator is capable of pulling the article 11, which is grasped between the fingers 136 (see FIG. 1B) and 137, therefrom notwithstanding the pressurized air in the hose 148. This enables the operator to pull the article 11 (see FIG. 1A) from between the fingers 136 (see FIG. 1B) and 137 of the gripper 135 when desired for placing on the second of the article transport apparatuses 10.

When another of the articles 11 (see FIG. 1A) is positioned on the clamping mechanisms 45 and 46 and the push button 122 (see FIG. 2) of the switch 120 depressed, the solenoid valve 134A (see FIG. 14) again allows pressurized air to be supplied through the hoses 124 and 125 to the clamping mechanisms 45 (see FIG. 1A) and 46, respectively. This allows pressurized air to be supplied to the pilot activator 172 (see FIG. 14) to again shift the four-way valve 170. As a result, pressurized air is supplied through the hose 167 and vented through the hoses 168 and 173. This causes the piston rod 162 to be retracted into the air cylinder 163 and to move the gripper 135 (see FIG. 1B) therewith.

The venting of the hose 168 (see FIG. 14) also vents the hose 173. This results in the gripper fingers 136 (see FIG. 1B) and 137 being moved apart so that the fingers 136 and 137 can have the next of the articles 11 (see FIG. 1A) clamped to the table 28 by the clamping mechanisms 45 and 46 pass therebetween as the table 28 is advanced towards the gripper 135 (see FIG. 1B) by the stepping motor 37 (see FIG. 1A).

When the piston rod 162 is fully retracted, a projection 179 (see FIG. 1B) on the valve 174 engages a projection 180 (see FIG. 1A) on a stop 181, which is mounted in a fixed position on the bar 17. The engagement of the projection 179 (see FIG. 1B) on the valve 174 with the projection 180 (see FIG. 1A) on the stop 181 insures that the valve 174 (see FIG. 1B) is positioned so that pressurized air will be supplied through the hose 148 to the air cylinders 143 and 147 when pressurized air is again supplied through the hoses 168 (see FIG. 14) and 173 to the valve 174. This occurs when the piston rod 162 is again extended after the clamping mechanisms 45 (see FIG. 1A) and 46 have been released.

Figure 7:
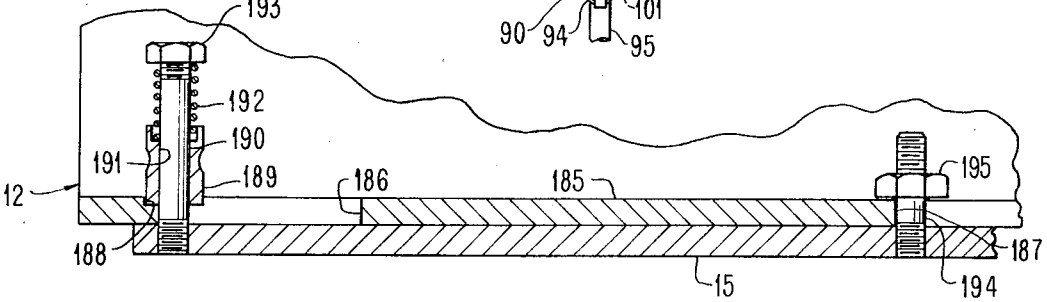
FIG. 7 is a fragmentary sectional view showing the arrangement for adjustably mounting the fastener apparatus to the article transport apparatus.

The fastener apparatus 12 is mounted on a support plate 185 (see FIG. 7). The support plate 185 is slidable along the upper surface of the base plate 15 so that the fastener apparatus 12 can be quickly removed from adjacent the table 28 (see FIG. 1A) when desired or necessary.

The support plate 185 (see FIG. 7) has a pair of longitudinal slots 186 and 187 therein and aligned with each other. The slot 186 has a circular recess 188 at one end to receive a circular lock element 189, which is slidably mounted on a bolt 190 attached to the base plate 15 and extending upwardly therefrom through the slot 186 and a passage 191 in the lock element 189. A spring 192 acts between a nut 193 on the upper end of the bolt 190 and the lock element 189. The nut 193 is adjustable on the bolt 190 to adjust the force on the spring 192.

A bolt 194, which is attached to the base plate 15, extends through the slot 187 in the support plate 185 and has a nut 195 on its upper end. Thus, the bolt 194 serves as a guide post or pin.

Accordingly, when it is desired to quickly remove the fastener apparatus 12 away from the table 28 (see FIG. 1A), the lock element 189 (see FIG. 7) is lifted from the circular recess 188 in the support plate 185. This enables the support plate 185 with the fastener apparatus 12 attached thereto to be moved to the left in FIG. 7, which is the desired direction away from the table 28 (see FIG. 1A). The maximum movement of the fastener apparatus 12 away from the table 28 is limited by the right edges of the slots 186 (see FIG. 7) and 187 in the support plate 185.

The maximum movement of the table 28 (see FIG. 1A) to the right is limited by a microswitch 196, which is supported on the plate 16, having its stem 197 engaged by the switch actuator 134. When this occurs, activation of the motor 37 is stopped.

The maximum movement of the table 28 to the left is limited by a switch actuator 198, which is supported on the block 30, engaging the stem 197 of the microswitch 196. This also inactivates the motor 37 irrespective of any signals from the computer within the control box 126.

The computer in the control box 126 may be programmed to any one of a particular of programs. The computer is capable of storing different programs that can be changed, updated, and recalled.

This enables a program to be selected very quickly and easily. This also insures that the two article transport apparatuses 10 are moved precisely the same distances for the two opposite edges of the jacket, for example, to which the fastener elements are to be attached.

Figure 13:
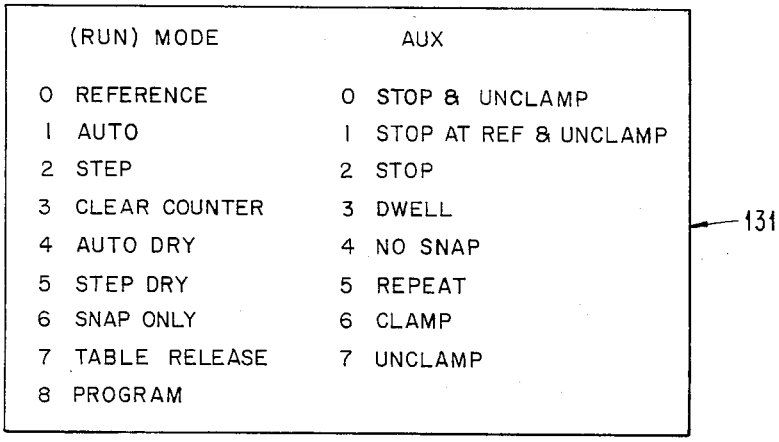
FIG. 13 is a front elevational view of a panel on the control box of the article transport apparatus of FIG. 1A.

As shown in FIG. 13, the panel 131 has nine different modes listed thereon in which the computer in the control box 126 (see FIG. 1A) can be run. These are as follows:

0. REFERENCE
   This mode will cause the table 28 (see FIG. 1A) to move in a negative direction (to the right) until it actuates the switch 132, which is the home switch, when the MODE (run) push button 130 (see FIG. 12) is actuated. If the table 28 (see FIG. 1A) was parked to the negative (right) side of the switch 132 when the MODE push button 130 (see FIG. 12) was activated, the movement of the table 28 (see FIG. 1A) to the right will actuate the overtravel switch 196 through the switch actuator 134 and stop with the motor 37 deactivated allowing the operator to manually push the table 28 back to the positive (left) side of the switch 132 before activating the MODE (run) push button 130 (see FIG. 12) again. Program operating modes 1, 2, 4, and 5 require the table 28 (see FIG. 1A) to have the switch actuator 134 actuating the home switch 132 before accepting any actuations of the MODE (run) push button 130 (see FIG. 12).
1. AUTO
   This mode executes the selected parts program of attaching a fastener element at each distance X from the prior fastener position, unless an A4 Code is encountered, until a stop (A2) Code is detected. The clamping mechanisms 45 (see FIG. 1A) and 46 are closed before any motion of the table 28 is executed and released when an A0, A1, or A7 Code is executed.
2. STEP
   This mode is the same as the AUTO mode except that only one instruction is executed with each activation of the MODE (run) push button 130 (see FIG 12).
3. CLEAR COUNTER
   This mode is used to reset the cycle count back to zero. The counters will not reset until the 0 push button 130 is detected by the control after the MODE (run) push button 130, the 3 push button 130, the ENTR push button 130, and the 0 push button 130 have been depressed in this order.
4. AUTO DRY
   This mode is the same as AUTO mode but no product is attached. Machine motions and clamp actions are all executed. This mode is used for parts program checkout and no cycle counts are made.
5. STEP DRY
   This mode is the same as the STEP mode with no product attached. Machine motions and clamp actions are all executed. This mode is used for parts program checkout and no cycle counts are made.
6. SNAP ONLY
   This mode allows the operator to actuate the fastener apparatus 12 (see FIG. 1A) with the MODE (run) push button 130 (see FIG. 12). The fastener apparatus 12 (see FIG. 1A) will free run as long as the MODE (run) push botton 130 (see FIG. 12) is held depressed.
7. TABLE RELEASE
   This mode deactivates the motor 37 (see FIG. 1A) to allow manual positioning of the table 28.
8. PROGRAM
   This mode allows the operator to enter a parts program into memory.

There also is a group of auxiliary codes as shown in FIG. 13. These auxiliary codes are as follows:

0. STOP AND UNCLAMP
   This code causes a cycle stop and the clamping mechanisms 45 (see FIG. 1A) and 46 to open when encountered. This code requires an A1 Code to follow it in order to position the table 28 back to the switch 132. The MODE (run) push button 130 (see FIG. 12) must be actuated before the A1 Code is executed by depressing the A push button 130 (see FIG. 12) and the 1 push botton 130.

1. STOP AT REF AND UNCLAMP
   This code causes the table 28 (see FIG. 1A) to return back to the switch 132, unclamp the article 11, and stop the cycle. This usually will be the last instruction of a parts program.
2. STOP
   This code causes a cycle stop at the existing position of the table 28. This requires A1 to return to table 28 to the switch 132. The MODE (run) push button 130 (see FIG. 12) must be actuated before A1 will be executed.
3. DWELL
   This code requires a second numeric entry which represents a 0.5 second per unit delay, i.e., A32 would cause a one second delay since 2 would represent 1 second. The delay starts when the code is encountered.
4. NO SNAP
   This code inhibits the fastener apparatus 12 (see FIG. 1A) after the next distance X is executed. The inhibit is only active for one distance X and is used to park the table 28 at an extreme positive position for unloading. This is generally followed by A0 or A2 and A7 Code to unclamp the article 11 and then an A1 to return the table 28 to the switch 132.
5. REPEAT
   This code requires a second numeric digit which directs the control to repeat the next distance X command from the prior position as many times as the value of the second digit. Thus, A54 would attach a product at each of the next four steps of the table 28 with each being at the same distance X from the prior position and the distance X being dictated by the next X entry.
6. CLAMP
   This code causes the clamping mechanisms 45 and 46 to close. This may possibly never be used as the control automatically closes the clamping mechanisms 45 and 46 before any motions of the table 28 are executed. This could be used with an A2, A7 combination in the middle of a parts program.
7. UNCLAMP
   This code causes the clamping mechanisms 45 and 46 to release when encountered and could be used with a dwell after the last fastener element is attached to release the article 11 without causing a cycle stop.

Accordingly, when a program is to be made, the MODE (run) push button 130 (see FIG. 12), the 8 push button 130, and the ENTR push button 130 must be depressed in sequence. Then, the P push button 130 must be depressed along with two numbers to identify the program after which the ENTR push button 130 is again depressed. If the program is to be identified as the first program, then the 0 push button 130 and the 1 push button 130 would be punched in sequence.

The X push button 130 is utilized to indicate the distance to which the table 28 (see FIG. 1A) is to be moved from its prior position. If the X push button 130 (See FIG. 12) is pushed along with the 0 push button 130 being pushed twice and then the ENTR push button 130 is pushed, this indicates that the first position is at the upper edge of the article 11 (see FIG. 1A) that is aligned with the mark 67 (see FIG. 2). The program automatically compensates for the 0 position being 2.5 inches from the home position. Thus, any initial entry below 25 will initially cause motion of the table 28 to the right in FIG. 1A. Each additional location again has the X push button 130 (see FIG. 12) activated along with two numerals and then the ENTR push button 130. At the completion of the various distances at which the fastener elements are to be attached to the article 11 (see FIG. 1A), the program is completed with depressing the A push button 130 (see FIG. 12), the 1 push button 130, and the ENTR push button 130 in sequence. This causes the table 28 (see FIG. 1A) to be moved to the home position, the clamping mechanisms 45 and 46 inactivated, and motor 37 stopped.

Figure 11:
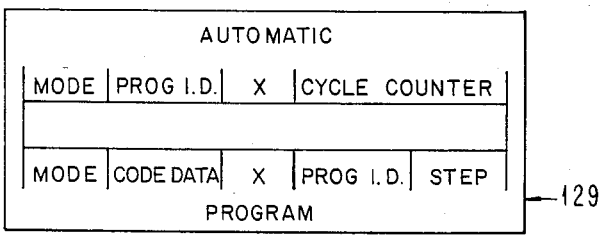
FIG. 11 is a front elevational view of a display of a control box of the article transport apparatus of FIG. 1A.

The display 129 (see FIG. 11) discloses the various information in the mode operation other than the program mode under AUTOMATIC. The information concerning the program mode, which is being written, is found in the PROGRAM portion of the display 129.

While the article transport apparatus 10 (see FIG. 1A) has been described as being controlled by the computer in the control box 126 and the program with which it is being run, it should be understood that any other suitable control means could be employed. It is only necessary that the solenoid valve 134A (see FIG. 14), which allows the pressurized air to be supplied to the clamping mechanisms 45 and 46, be responsive to an electric signal and that the motor 37 (see FIG. 1A) have a slight delay before starting after the push button 122 (see FIG. 2) of the switch 120 is depressed. The number of steps that the motor 37 (see FIG. 1A) makes would be controlled by some type of a counting mechanism, for example. After each motion of the table 28 to a new position, stopping of the motor 37 could transmit a signal to activate the solenoid valve 134B (see FIG. 14), which supplies the pressurized air through the main pilot valve 134C to the air cylinders of the fastener apparatus 12 (see FIG. 1A). Then, the return of the pistons in the air cylinders of the fastener apparatus 12 to their home positions could generate an electric signal to deactivate the solenoid valve 134B (see FIG. 14), which controls the flow of pressurized air through the main pilot valve 134C to the air cylinders of the fastener apparatus 12 (see FIG. 1A), and to again activate the motor 37.

When the last of the fastener elements is attached to the last of the selected portions of the article 11 held by the clamping mechanisms 45 and 46, the motor 37 could be stepped the required amount to dispose the table 28 at the home position and the clamping mechanisms 45 and 46 released.

While the article transport apparatus 10 has been shown and described as utilizing the fastener apparatus 12, it should be understood that any other type of apparatus for performing some type of operation or process on selected portions of an article at a fixed location may be utilized. For example, a sewing machine could be employed to sew elements at various spaced portions of an article or articles.

In order to control the pressures acting on the piston 104 (see FIG. 5) and the piston 88 (see FIG. 4) of the cylinder block 84, a pressure regulator 199 (see FIG. 14) is disposed between the connector 123 and the hose 125. A pressure gauge 200 communicates with the hose 125 to enable the pressure in the hose 125 to be adjusted to the desired value through the pressure regulator 199.

An advantage of this invention is that it reduces the time to attach fastener elements to an article of clothing. Another advantage of this invention is that there is no necessity to mark the desired locations of the fastener elements on the article so that there can be no error through erroneously marking the location at which the fastener elements are to be attached. A further advantage of this invention is that spacing of the fastener elements for one size or type of article can be quickly changed to a different spacing for fastener elements for another article.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

We claim:

1. An article transport apparatus for positioning various selected and spaced portions of an article at a fixed location in a selected order including:

support means to support an article having selected and spaced portions for positioning at a fixed location in a selected order;

clamping means to clamp the article on said support means in a fixed relation to a predetermined location on said support means;

moving means to move said support means along a predetermined reciprocating path relative to a fixed location during a cycle of operation;

said clamping means being disposed on said support means for movement with said suport means;

first causing means to cause activation of said moving means;

second causing means to cause inactivation of said moving means when each selected portion of the article to be disposed at the fixed location is disposed at the fixed location by said moving means;

processing means to perform a process on each of the selected portions of the article when the selected portion of the article is disposed at the fixed location and said moving means is inactivated;

said moving means moving said support means during a cycle of operation from its home position in one direction along the predetermined reciprocating path to position at least one selected portion of the article at the fixed location for processing by said processing means, in the opposite direction along the predetermined reciprocating path after said processing means has performed a process on the at least one selected portion of the article to position at least one other selected portion of the article at the fixed location for processing by said processing means, and in the one direction along the predetermined reciprocating path after completion of processing by said processing means to return said support means to its home position;

said clamping means clamping the article on said support means during a cycle of operation to prevent any relative movement between said support means and the article supported thereon until at least completion of processing by said processing means during a cycle of operation;

activating means to activate said first causing means after each of the selected portions of the article has been disposed at the fixed location and subjected to the process by said processing means;

and means to render said clamping means ineffective only after processing by said processing means is completed during a cycle of operation.

2. The apparatus according to claim 1 including limit means to limit the maximum movement in each direction of said support means from its home position disposed at a selected distance in one direction along the predetermined reciprocating path from the fixed location.

3. The apparatus according to claim 2 including means to prevent said first causing means from initially being effective until said clamping means is effective during a cycle of operation.

4. The apparatus according to claim 3 including means to prevent said activating means from activating said first causing means until said processing means has completed the process on the selected portion of the article disposed at the fixed location.

5. The apparatus according to claim 4 in which said clamping means includes:

first clamping means disposed on said support means at a fixed location;

second clamping means adjustably disposed on said support means at a selected distance from said first clamping means;

and said second clamping means includes tension increasing means to increase the tension on the article after it is clamped by said first clamping means and said second clamping means and before any processing by said processing means.

6. The apparatus according to claim 4 in which said clamping means includes:

first clamping means disposed on said support means at a fixed location;

first movable means to be selectively locked to said support means at a selected distance from said first clamping means;

second clamping means to clamp the article, said second clamping means being supported by said first movable means for movement relative to said first movable means;

and means to shift said second clamping means relative to said first movable means after said first clamping means and said second clamping means have clamped the article to increase the tension on the clamped article.

7. The apparatus according to claim 1 including means to prevent said first causing means from initially being effective until said clamping means is effective during a cycle of operation.

8. The apparatus according to claim 1 including:

control means to control said moving means to cause movement of said support means in one direction from its home position to enable said processing means to perform a process on at least one selected portion of the article between one of said first and second clamping means and the portion of the article at the fixed location when said support means is in its home position, to cause movement of said support means in the opposite direction after completion of processing by said processing means of at least the one selected portion of the article between said one clamping means and the portion of the article at the fixed location when said support means is in its home position to enable said processing means to perform a process on at least one other selected portion of the article between the other of said first and second clamping means and the portion of the article at the fixed location when said support means is in its home position, and to cause movement of said support means in the one direction after completion of processing by said processing means to return said support means to its home position.

9. The apparatus according to claim 1 including:

storage means to store each of the positions of said support means at which said support means is to be stopped at the fixed location;

and means to utilize said storage means when the article is positioned on a duplicate apparatus so that processing by said processing means occurs at the same positions during a cycle of operation of the duplicate apparatus.

10. The apparatus according to claim 1 in which said rendering means renders said clamping means ineffective only when movement of said support means by said moving means is completed during a cycle of operation.

11. The apparatus according to claim 2 including:

means to stop said support means at its home position upon completion of a cycle of operation;

and said stopping means including said rendering means.

12. An article transport apparatus for positioning various selected and spaced portions of an article at a fixed location in a selected order including:

support means to support an article having selected and spaced portions for positioning at a fixed location in a selected order;

clamping means to clamp the article on said support means in a fixed relation to a predetermined location on said support means;

moving means to move said support means along a predetermined reciprocating path relative to a fixed location during a cycle of operation;

first causing means to cause activation of said moving means;

second causing means to cause inactivation of said moving means when each selected portion of the article to be disposed at the fixed location is disposed at the fixed location by said moving means;

processing means to perform a process on each of the selected portions of the article when the selected portion of the article is disposed at the fixed location and said moving means is inactivated;

activating means to activate said first causing means after each of the selected portions of the article has been disposed at the fixed location and subjected to the process by said processing means;

means to render said clamping means ineffective only after processing by said processing means is completed during a cycle of operation;

and said clamping means including:

first clamping means disposed on said support means at a fixed location;

second clamping means adjustably disposed on said support means at a selected distance from said first clamping means;

and said second clamping means including tension increasing means to increase the tension on the article after it is clamped by said first clamping means and said second clamping means and before any processing by said processing means.

13. An article transport apparatus for positioning various selected and spaced portions of an article at a fixed location in a selected order including:

support means to support an article having selected and spaced portions for positioning at a fixed location in a selected order;

clamping means to clamp the article on said support means in a fixed relation to a predetermined location on said support means;

moving means to move said support means along a predetermined reciprocating path relative to a fixed location during a cycle of operation; p1 first causing means to cause activation of said moving means;

second causing means to cause inactivation of said moving means when each selected portion of the article to be disposed at the fixed location is disposed at the fixed location by said moving means;

processing means to perform a process on each of the selected portions of the article when the selected portion of the article is disposed at the fixed location and said moving means is inactivated;

activating means to activate said first causing means after each of the selected portions of the article has been disposed at the fixed location and subjected to the process by said processing means;

means to render said clamping means ineffective only after processing by said processing means is completed during a cycle of operation;

and said clamping means including:

first clamping means disposed on said support means at a fixed location;

first movable means to be selectively locked to said support means at a selected distance from said first clamping means;

second clamping means to clamp the article, said second clamping means being supported by said first movable means for movement relative to said first movable means;

and means to shift said second clamping means relative to said first movable means after said first clamping means and said second clamping means have clamped the article to increase the tension on the clamped article.

14. The apparatus according to claim 13 in which:

said second clamping means includes:

a support slidably mounted on said first movable means of said clamping means;

article engaging means to clamp the article against said support;

and means to render said article engaging means effective;

and said shifting means shifts said support and said article engaging means relative to said first movable means of said clamping means after said article engaging means is rendered effective by said rendering means of said second clamping means to increase the tension on the clamped article.

15. An article transport apparatus for positioning various selected and spaced portions of an article at a fixed location in a selected order including:

support means to support an article having selected and spaced portions for positioning at a fixed location in a selected order;

clamping means to clamp the article on said support means in a fixed relation to a predetermined location on said support means;

moving means to move said support means along a predetermined reciprocating path relative to a fixed location during a cycle of operation;

limit means to limit the maximum movement in each direction of said support means from its home position disposed at a selected distance in one direction along the predetermined reciprocating path from the fixed location;

first causing means to cause activation of said moving means;

means to prevent said first causing means from initially being effective until said clamping means is effective during a cycle of operation;

second causing means to cause inactivation of said moving means when each selected portion of the article to be disposed at the fixed location is disposed at the fixed location by said moving means;

processing means to perform a process on each of the selected portions of the article when the selected portion of the article is disposed at the fixed location and said moving means is inactivated;

activating means to activate said first causing means after each of the selected portions of the article has been disposed at the fixed location and subjected to the process by said processing means;

means to prevent said activating means from activating said first causing means until said processing means has completed the process on the selected portion of the article disposed at the fixed location;

first rendering means to render said clamping means ineffective;

gripping means to grip the article clamped by said clamping means;

and second rendering means to render said gripping means effective to grip the article clamped by said clamping means upon the clamped article being released by said clamping means.

16. The apparatus according to claim 15 in which said clamping means includes:

first clamping means disposed on said support means at a fixed location;

second clamping means adjustably disposed on said support means at a selected distance from said first clamping means;

and said second clamping means includes tension increasing means to increase the tension on the article after it is clamped by said first clamping means and said second clamping means and before any processing by said processing means.

17. Th apparatus according to claim 11 including means to render said first clamping means and said second clamping means effective simultaneously.

18. The apparatus according to claim 15 in which said clamping means includes:

first clamping means disposed on said support means at a fixed location;

first movable means to be selectively locked to said support means at a selected distance from said first clamping means;

second clamping means to clamp the article, said second clamping means being supported by said first movable means for movement relative to said first movable means;

and means to shift said second clamping means relative to said first movable means after said first clamping means and said second clamping means have clamped the article to increase the tension on the clamped article.

19. The apparatus according to claim 18 including means to render said first clamping means and said second clamping means effective simultaneously.

20. The apparatus according to claim 15 including control means to control when said gripping means is rendered ineffective after said gripping means has gripped the article.

21. The apparatus according to claim 15 including:

means to mount said gripping means for movement relative to said support means;

and means to move said gripping means a selected distance relative to said support means after said second rendering means has rendered said gripping means effective.

22. An article transport apparatus for positioning various selected and spaced portions of an article at a fixed location in a selected order including:

support means to support an article having selected and spaced portions for positioning at a fixed location in a selected order;

clamping means to clamp the article on said support means in a fixed relation to a predetermined location on said support means;

moving means to move said support means along a predetermined reciprocating path relative to a fixed location during a cycle of operation;

first causing means to cause activation of said moving means;

second causing means to cause inactivation of said moving means when each selected portion of the article to be disposed at the fixed location is disposed at the fixed location by said moving means;

processing means to perform a process on each of the selected portions of the article when the selected portion of the article is disposed at the fixed location and said moving means is inactivated;

activating means to activate said first causing means after each of the selected portions of the article has been disposed at the fixed location and subjected to the process by said processing means;

first rendering means to render said clamping means ineffective;

gripping means to grip the article clamped by said clamping means and second rendering means to render said gripping means effective to grip the article clamped by said clamping means upon the clamped article being released by said clamping means.

23. The apparatus according to claim 22 in which said clamping means includes:

first clamping means disposed on said support means at a fixed location;

second clamping means adjustably disposed on said support means at a selected distance from said first clamping means;

and said second clamping means includes tension increasing means to increase the tension on the article after it is clamped by said first clamping means and said second clamping means and before any processing by said processing means.

24. The apparatus according to claim 22 in which said clamping means includes:

first clamping means disposed on said support means at a fixed location;

first movable means to be selectively locked to said support means at a selected distance from said first clamping means;

second clamping means to clamp the article, said second clamping means being supported by said first movable means for movement relative to said first movable means;

and means to shift said second clamping means relative to said first movable means after said first clamping means and said second clamping means have clamped the article to increase the tension on the clamped article.

25. The apparatus according to claim 22 including control means to control when said gripping means is rendered ineffective after said gripping means has gripped the article.

26. The apparatus according to claim 22 in which said processing means includes application means at the fixed location to apply fastener means to the article at each of the selected portions of the article.

27. The apparatus according to claim 22 including:

means to mount said gripping means for movement relative to said support means;

and means to move said gripping means a selected distance relative to said support means after said second rendering means has rendered said gripping means effective.

* * * * *

UNITED STATES PATENT AND TRADEMARK OFFICE

CERTIFICATE OF CORRECTION

PATENT NO. : 4,540,111

DATED : September 10, 1985

INVENTOR(S) : Volker Schmidt et al

It is certified that error appears in the above-identified patent and that said Letters Patent is hereby corrected as shown below:

Column 1, line 58, "said" should read --- each ---.

Column 2, line 5, "be" should read --- by ---.

Column 3, line 59, "bars" should read --- bar ---.

Column 4, line 31, "relations" should read --- relation ---.

Column 6, line 5, "a" (second occurrence) should read --- an ---.

line 10, "outer" should read --- other ---.

line 42, "92" should read --- 93 ---.

Column 7, line 59, "11" should read --- 111 ---.

Column 11, line 51, "mechanism" should read --- mechanisms ---.

Column 13, line 50, "particular" should read --- plurality ---.

Column 14, line 3, "activated" should read --- actuated ---.

Column 15, line 2, "botton" should read --- button ---.

line 10, "to" (second occurrence) should read --- the ---.

UNITED STATES PATENT AND TRADEMARK OFFICE

CERTIFICATE OF CORRECTION

PATENT NO. : 4,540,111

DATED : September 10, 1985

INVENTOR(S) : Volker Schmidt et al

It is certified that error appears in the above—identified patent and that said Letters Patent is hereby corrected as shown below:

Column 15, line 62, "See" should read --- see ---.

Column 17, line 30, "suport" should read --- support ---.

Column 20, line 6, cancel "pl"

line 6, "first" should be the start of a new paragraph

Column 21, line 45 "Th" should read --- The ---.

Column 22, line 39, after "means" (first occurrence) insert a --- semi-colon (;) ---.

line 39, "and" should be the start of a new paragraph.

Signed and Sealed this

*Tenth* Day of *December 1985*

[SEAL]

*Attest:*

DONALD J. QUIGG

*Attesting Officer* *Commissioner of Patents and Trademarks*